United States Patent [19]
Yorke et al.
[11] 4,404,050
[45] Sep. 13, 1983

[54] WATER-IN-OIL EMULSION BLASTING AGENTS CONTAINING UNREFINED OR PARTLY REFINED PETROLEUM PRODUCT AS FUEL COMPONENT

[75] Inventors: William J. Yorke, St. Bruno de Montarville; Rejean Binet, St. Bruno; Ming C. Lee, Longueuil; Howard A. Bampfield, Otterburn Park, all of Canada

[73] Assignee: C-I-L Inc., North York, Canada

[21] Appl. No.: 427,495

[22] Filed: Sep. 29, 1982

[51] Int. Cl.[3] ..... C06B 45/00
[52] U.S. Cl. ..... 149/2; 149/46; 149/60; 149/61; 149/76; 149/83; 149/85

[58] Field of Search ..... 149/46, 60, 61, 76, 149/83, 85

[56] References Cited

U.S. PATENT DOCUMENTS 4,315,787 2/1982 Hattori et al. ..... 149/2

*Primary Examiner*—Stephen J. Lechert, Jr.

[57] ABSTRACT

A water-in-oil emulsion explosive composition is provided wherein the continuous carbonaceous oil or fuel phase comprises an unrefined or partly refined petroleum product, for example, slackwax. The resulting explosive composition exhibits properties of strength, detonation velocity and stability comparable and in some cases superior to similar compositions containing refined petroleum fuels.

8 Claims, No Drawings

WATER-IN-OIL EMULSION BLASTING AGENTS CONTAINING UNREFINED OR PARTLY REFINED PETROLEUM PRODUCT AS FUEL COMPONENT

The present invention relates to water-in-oil emulsion explosive compositions which consist of a continuous carbonaceous fuel phase which is external, and a discontinuous aqueous oxidizing salt solution phase which is internal. In particular, the invention relates to such emulsion explosive compositions containing a carbonaceous fuel phase which is advantageous over those disclosed in the prior art.

Water-in-oil emulsion explosives are now well known in the explosives art and have been demonstrated to be safe, economic and simple to manufacture and to yield excellent blasting results. Bluhm, in U.S. Pat. No. 3,447,978, disclosed an emulsion explosives composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-oil explosives compositions. These include U.S. Pat. No. 3,674,578, Cattermole et al.; U.S. Pat. No. 3,770,522, Tomic; U.S. Pat. No. 3,715,247, Wade; U.S. Pat. No. 3,765,964, Wade U.S. Pat. No. 4,110,134, Wade; U.S. Pat. No. 4,149,916, Wade; U.S. Pat. No. 4,141,817, Wade; U.S. Pat. No. 4,141,767, Sudweeks and Jessup; Canadian Pat. No. 1,096,173, Binet and Seto; U.S. Pat. No. 4,111,727, Clay; U.S. Pat. No. 4,104,092, U.S. Pat. No. 4,231,821, Sudweeks and Lawrence; U.S. Pat. No. 4,218,272, Brockington; U.S. Pat. No. 4,138,281, Olney and Wade, U.S. Pat. No. 4,216,040, Sudweeks and Jessup; and U.S. Pat. No. 4,287,010, Owen. In Canadian Pat. No. 1,106,835, Bent et al and in U.S. Pat. Nos. 4,259,977, Brockington and 4,273,147, Olney, methods are disclosed for the preparation and placement of emulsion explosive compositions.

All of the aforementioned emulsion type explosive compositions contain an essential emulsifier ingredient. Without the presence of such an emulsifier, the mixed phases of the compositions soon separate to form a layered mixture having no utility as an explosive. Additionally, all of the aforementioned compositions contain as the the carbonaceous fuel fluidizable carbonaceous ingredients in a substantially highly refined or purified state. For example, U.S. Pat. No. 4,231,821 discloses the use of materials selected from mineral oil, waxes, paraffin oils, benzene, toluene, xylenes and mixtures of liquid hydrocarbons generally referred to as gasoline, kerosene and diesel fuels. U.S. Pat. No. 4,218,272 discloses the use of highly refined microcrystalline waxes, for example, WITCO (Reg. TM) X145-A and ARISTO (Reg. TM) 143. In U.S. Pat. No. 4,110,134, the use is proposed of INDRA (Reg. TM) 2119, a substantially refined blend of petroleum, wax and oil and ATREOL (Reg. TM), a white mineral oil. The use of such refined or purified carbonaceous material as the continuous fuel phase of an emulsion explosive composition has heretofore been deemed essential.

According to the present invention a water-in-oil emulsion explosive composition is provided wherein the continuous carbonaceous fuel phase comprises an unrefined or partly refined petroleum product, the said petroleum product being characterized in that (a) the component molecules have between 20 and 80 carbon atoms and less than 50% of the said molecules have a number of carbon atoms within the same five carbon atom range, and, (b) wherein the said unrefined or partly refined petroleum product comprises at least 10% by weight of a flowable oil if the said petroleum product is in the form of a petroleum wax or, comprises at least 10% by weight of a distillation residuum if the said petroleum product is in the form of a petroleum oil or tar.

Particularly, the water-in-oil emulsion explosive composition of the invention comprises a continuous phase of from 1–10% by weight of an unrefined or partly refined petroleum product as hereinabove defined containing from 0.5–3% by weight of an emulsifying agent, a discontinuous phase of from 10% to 25% by weight of water and from 65% to 85% by weight of soluble inorganic oxygen-supplying salts, and a sufficient amount of a density lowering ingredient to maintain the composition at a density between 0.9 and 1.4 g/cc.

Exemplary of the unrefined or partly refined petroleum products suitable for use as the continuous fuel phase of the emulsion explosive compositions of the invention are slackwaxes, commercial wax/oils, residual fuel oils, asphalt, bunker oil, topped crude petroleum, petroleum tars, crude petroleum, bitumens, weathered crude petroleum and blended fuel oil.

By slackwax is meant the wax which results from the incomplete pressing of settlings from petroleum distillates and which contains at least 10% by weight and usually 10% to 25% of oil.

By commercial wax/oils is meant semi-solid mixtures of hydrocarbon oil and soft petroleum waxes and containing at least 10% by weight and usually over 25% of oil.

By residual fuel oil is meant topped crude petroleum or viscous residuals obtained in refinery operations or combinations of these materials with distilled petroleum.

By asphalt is meant a black to dark-brown solid or semi-solid cementitious material which liquefies when heated, in which the predominant constituents are bitumens or combinations of bitumens with petroleum or petroleum derivatives.

By bunker oil is meant heavy residual fuel oil.

By topped crude petroleum is meant a residual product remaining after separation by distillation or other means from crude petroleum of a substantial quantity of the more volatile components.

By petroleum tars is meant viscous black or dark-brown product obtained in petroleum refining which when partially evaporated or fractionally distilled yield a substantial quantity of solid residue.

By bitumens is meant solid or semi-solid mixtures consisting predominantly of hydrocarbons which occur in nature or are obtained in petroleum refining operations.

By weathered crude petroleum is meant products resulting from crude petroleum through loss due to natural causes during storage and handling of an appreciable quantity of the more volatile components.

By crude petroleum is meant a naturally occurring mixture comprising predominantly hydrocarbons together with some or all of sulfur, nitrogen or oxygen derivatives of hydrocarbons which is capable of being removed from the earth in a liquid state.

Petroleum wax is a product separated from petroleum which is solid or semi-solid at 25° C. and consists essentially of a mixture of saturated hydrocarbons. Distillation residuums are the bottoms or residuals remaining after commercial distillation of petroleum whose dominant components have boiling points in excess of 593° C. at atmospheric pressure.

It has been found, contrary to all expectations, that the use of crude or unrefined petroleum products as the continuous fuel phase in an emulsion explosive composition has no deleterious effect on the properties of the resultant explosive composition; that is, the strength, the detonation velocity, the stability and storage properties are generally undiminished when compared to compositions comprising refined hydrocarbons and, in some cases, are markedly improved. Indeed, it has been surprisingly found that the use of unpurified petroleum fuels provide emulsion explosives which are cap-sensitive even in small diameter charges. An additional and obvious advantage in the use of unrefined petroleum fuels is the substantial economic advantage enjoyed over the previously used, high cost, refined oils and waxes. Furthermore, in the prior art compositions, careful blending of the refined oils and waxes is typically required in order to provide emulsions having suitable rheology for practical cartridging. By employing unrefined petroleum fuels, an explosive product of high viscosity having good cartridging characteristics results without the need for fuel blending.

A particular advantage of the present invention lies in the property of explosive compositions containing unrefined fuels to tenaciously retain void spaces such as are provided by chemically generated or physically entrained gas bubbles. This unexpected property if of significant economic advantage since it eliminates the need for the incorporation into the composition of expensive void-containing material such as glass or resin microspheres.

The discontinuous aqueous component or phase of the emulsified explosive will have a dissolved inorganic oxygen-supplying salt therein. Such an oxidizer salt will generally be ammonium nitrate but a portion of the ammonium nitrate can be replaced by one or more other inorganic salts such as, for example, the alkali or alkaline earth metal nitrates or perchlorates.

Typical of emulsifiers suitable for use in the composition are the monomeric emulsifiers such as the saturated fatty acids and fatty acid salts, glycerol stearates, esters of polyethylene oxide, fatty amines and esters, polyvinyl alcohol, sorbitan esters, phosphate esters, polyethylene glycol esters, alkylaromatic sulphonic acids, amides, triethanolamine oleate, amine acetate, imidazolines, unsaturated fatty chain oxazolines, and mercaptans. Among the polymeric emulsifiers which may be employed are the alkyds, ethylene oxide/propylene oxide copolymers and hydrophobe/hydrophil block copolymers. Also suitable is an emulsifier which is the reaction product of glycerol and a dimer acid. In some cases, mixtures or blends of emulsifiers are used. The emulsifier chosen will be the one which functions most expeditiously in the environment of the emulsion explosive being formulated.

Additionally, the emulsion explosive of the invention may contain optional additional fuel, sensitizer or filler ingredients, such as, for example, glass or resin microspheres, particulate light metal, void-containing material such as styrofoam beads or vermiculite, particulate carbonaceous material, for example, gilsonite or coal, vegetable matter such as ground nut hulls or grainhulls, sulfur and the like.

Air or gas bubbles, for density modification and sensitization purposes, may be injected or mixed into the emulsion composition or may be generated in situ for a gas generating material such as a peroxide or sodium nitrite.

The emulsion explosives of the present invention are, preferably, made by preparing a first premix of water and inorganic oxidizer salt and a second premix of crude fuel and emulsifying agent. The aqueous premix is heated to ensure dissolution of the salts and the fuel premix is heated to provide liquidity. The premixes are blended together and emulsified in a mechanical blade mixer, rotating drum mixer or by passage through an in-line static mixer. Thereafter, the density lowering material, for example, glass microspheres, are added along with any auxiliary fuel and the final product packaged into suitable cartridges or containers.

In general, the water-in-oil emulsion explosive compositions of the present invention are sensitive to initiation by blasting cap in small diameter (2.5 cm.) charges at ambient temperatures. The compositions display excellent storage properties and show no signs of demulsification, retaining cap sensitivity in most cases after being subjected to 10 temperature cycles of −17° C. to +35° C. or after being stored over a two-month period at 35° C.

The following Examples and Tables provide a more complete understanding of the present invention.

EXAMPLES 1-16

A water-in-oil emulsion explosive composition was prepared according to the following formula, all parts being expressed as percentage by weight:

Ammonium nitrate: 61.5
Sodium nitrate: 14.9
Calcium nitrate: 4.6
Water: 13.0
Emulsifier: 1.7
Fuel: 4.3

The emulsifier consisted of a blend of 0.3% of a polymeric emulsifier, 0.7% of sorbitan sesqui-oleate and 0.7% of soya lecithin. A variety of refined and crude fuels were employed in separate batches and the resultant compositions were packaged in 2.54 cm. diameter plastic tubular containers. The cartridges were tested for minimum primer detonation and velocity of detonation as made and after two months storage at 35° C. and after 10 temperature cycles of +35° C. and −17° C. The various fuels employed are shown in Table I below and the comparative performance results are shown in Table II.

TABLE I

| Fuel | Supplier | Description |
|---|---|---|
| A. Refined Fuels | | |
| Paraflex* HT-22 | Gulf Oil Canada | Paraffin oil |
| Refined Paraffin Wax 1230 | International Waxes Ltd. | Refined paraffin wax |
| Flexowax* C | Glyco Chemical | Refined microcrystalline wax |
| Multiwax 445 | Glyco Chemical | Refined microcrystalline wax |
| B. Crude Fuels | | |
| Slackwax 428 | International Waxes Ltd. | Medium melt-point paraffin slackwax |
| Slackwax 430 | International Waxes Ltd. | Crude microcrystalline wax |
| Slackwax 431 | International Waxes | Paraffin slackwax |

TABLE I-continued

| Fuel | Supplier | Description |
|---|---|---|
| | Ltd. | |
| Petrofibe* 206 | International Waxes Ltd. | Low pour-point wax oil |
| Petrofibe* 225 | International Waxes Ltd. | Mixture of soft waxes and oils |
| Bunker Oil 6C | Gulf Oil Canada | Heavy residual oil |
| Asphalt 85–100 | Gulf Oil Canada | Petroleum residue |

*Reg. T.M.

TABLE II

| | | | | Properties as made | | Properties after storage | |
|---|---|---|---|---|---|---|---|
| Example No. | Fuel | Voids Type | Density (g.cc) | Minimum primer (m.p.) | V.O.D. (km/sec) | m.p. (V.O.D.) 10 cycles | m.p. (V.O.D.) 2 mo + 35° |
| 1 | 0.9% Multiwax 3.3% Flexowax | gas | 1.19 | R-7* | 3.4 | R-10 (2.9) (8 cycles) | |
| 2 | Slackwax | gas | 1.13 | R-6 | 4.4 | — | R-7 (4.0) |
| | | | 1.06 | R-7 | 4.3 | R-7 (4.1) | R-5 (4.0) |
| 3 | 1.0% Paraflex 3.3% Paraffin 1230 | gas | 1.14 | R-10 | 2.9 | — | F E.B |
| 4 | Slackwax 430 | gas | 1.12 | R-7 | 3.7 | R-7 (3.9) | R-8 (3.6) |
| 5 | Slackwax 431 | micro-spheres (glass) | 1.13 | R-7 | 4.5 | R-8 (4.4) | R-9 (4.3) |
| 6 | 2.7% Paraflex 1.5% Paraffin 1230 | m.s. | 1.15 | R-9 | 4.6 | F E.B. — | — |
| 7 | Slackwax 431 | plastic spheres | 1.13 | R-8 | 5.4 | E.B. (5.0) | E.B. (5.0) |
| 8 | Slackwax 431 | perlite | 1.16 | R-7 | 2.9 | E.B. (2.6) | E.B. (2.5) |
| 9 | Bunker Oil | m.s. | 1.13 | R-6 | 4.2 | E.B. (3.9) | R-10 (4.1) |
| 10 | Bunker Oil | gas | 1.32 | R-9 | 3.6 | R-9 (2.3) | R-9 (2.4) |
| 11 | Asphalt | m.s. | 1.11 | R-6 | 4.2 | E.B. (3.8) | R-15 (3.8) |
| 12 | Asphalt | gas | 1.27 | R-6 | 3.3 | R-9 (3.0) | R-9 (2.6) |
| 13 | Petrofibe 206 | gas | 1.25 | R-8 | 3.0 | R-11 (2.4) | F E.B. |
| 14 | Petrofibe 206 | m.s. | 1.13 | R-6 | 4.3 | R-15 (4.3) 5 cycles | F E.B. |
| 15 | Petrofibe 225 | gas | 1.17 | R-7 | 3.4 | R-11 (2.3) | F E.B. |
| 16 | Petrofibe 225 | m.s. | 1.14 | R-7 | 4.4 | R-9 (4.1) | R-10 (4.1) |

*Caps designated R-n contain 0.1 g initiating composition and (n-3) × 0.05 g PETN 13 ≧ n ≧ 4 or (n-13) × 0.1 + 0.5 g. PETN 16 ≧ n ≧ 14 base charge.
E.B. indicates electric blasting caps containing .08 g initiating composition and .78 g PETN.
F indicates a failure to detonate. All properties were measured at 5° C.

An examination of the results shown in Table II demonstrate that the use of crude or unrefined fuels as the continuous phase in an emulsion explosive provide compositions which have no less utility than those using more refined or pure fuels. A gassed slackwax formulation, for example, (Ex. 2) has an initial V.O.D. equivalent to that of a refined wax/glass microsphere formulations (Ex. 6) and higher than that of gassed refined wax formulations (Ex. 1 and 3). The storage properties of slackwax formulae, gassed (Ex. 2) or with microspheres (Ex. 5) are superior to refined wax formulations (Ex. 3 and 6). Compositions formulated with crude fuels using enclosed voids (Ex. 5, 7 and 8) or unenclosed voids (Ex. 2), remain cap-sensitive for up to two months at +35° C. or through 10 temperature cycles of from −17° C. to +35° C. Compositions which are cap-sensitive (Ex. 9–16) can be made using a variety of crude petroleum products and can be formulated with either gassing agents or void-containing material. The velocity of detonation of crude fuel-containing compositions varies with the type of void, from low (Ex. 8) to high (Ex. 7).

We claim:

1. A water-in-oil emulsion explosive composition comprising a continuous carbonaceous fuel phase and a discontinuous aqueous oxidizer salt solution phase wherein the said continuous carbonaceous fuel phase comprises an unrefined or partly refined petroleum product, the said petroleum product being characterised in that, (a) the component molecules have between 20 and 80 carbon atoms and less than 50% of the said molecules having a number of carbon atoms within the same five carbon atom range, and, (b) wherein the said unrefined or partly refined petroleum product comprises at least 10% by weight of flowable oil if the said petroleum product is in the form of a petroleum wax or comprises at least 10% by weight of a distillation residue if the said petroleum product is in the form of a petroleum oil or tar.

2. A composition as claimed in claim 1 wherein the said unrefined or partly refined petroleum product is selected from the group consisting of slackwax, commercial wax/oils, residual fuel oil, asphalt, bunker oil, topped crude petroleum, petroleum tars, crude petroleum, weathered crude petroleum, blended fuel oil, bitumens and mixtures of these.

3. A composition as claimed in claim 1 wherein the said carbonaceous fuel phase comprises up to 10% by weight of the total composition.

4. A composition as claimed in claim 1 containing an amount of density lowering ingredient to provide a composition density of from 0.9 to 1.4 grams per cubic centimeter.

5. A water-in-oil emulsion explosive composition comprising (a) a continuous phase of from 1% to 10% by weight of an unrefined or partly refined petroleum product wherein the component molecules have between 20 and 80 carbon atoms and less than 50% of the said molecules having a number of carbon atoms within the same five carbon atom range, and wherein the said refined or partly refined petroleum product comprises at least 10% by weight of flowable oil if the said petroleum product is in the form of a petroleum wax or comprises at least 10% by weight of a distillation residue if the said petroleum product is in the form of a petroleum oil or tar and from 0.5% to 3% by weight of an emulsifying agent, (b) a discontinuous phase of from 10% to 25% by weight of water and from 65% to 85% by weight of inorganic oxidizer salt, and, (c) an amount of density lowering ingredient to achieve a composition density of from 0.9 to 1.4 grams per cubic centimeter.

6. A composition as claimed in claim 4 or 5 wherein the said density lowering ingredient is selected from, solid particulate void-containing material, chemically generated gas bubbles, and entrained air bubbles or mixtures of these.

7. A composition as claimed in claim 5 wherein the said emusifying agent is selected from the group consisting of the monomeric emulsifiers comprising the saturated fatty acids and fatty acid salts, glycerol stearates, esters of polyethylene oxide, fatty amines and esters, polyvinyl alcohol, sorbitan esters, phosphate esters, polyethylene glycol esters, alkyl-aromatic sulphonic acids, amides, triethanolamine oleate, amine acetate, imidazolines, unsaturated fatty chain oxazolines and mercaptans, polymeric emulsifiers comprising the alkyds, ethylene oxide/propylene oxide copolymers and hydrophobe/hydrophil block copolymers, the reaction product of glycerol and a dimer acid, and mixtures or blends of these.

8. A composition as claimed in claim 1 or 5 wherein the said oxidizer salt comprises ammonium nitrate, alkali or alkaline earth metal nitrates and perchlorates and mixtures of these.

* * * * *